US006550769B1

(12) United States Patent
Munson

(10) Patent No.: US 6,550,769 B1
(45) Date of Patent: Apr. 22, 2003

(54) PUZZLE

(75) Inventor: Deborah Munson, Southwick, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/985,651

(22) Filed: Nov. 5, 2001

(51) Int. Cl.[7] ..... A63F 9/10
(52) U.S. Cl. ..... 273/153 R; 273/157 R
(58) Field of Search ..... 273/153 R, 156, 273/157 R, 155; D21/478, 480

(56) References Cited

U.S. PATENT DOCUMENTS

| | | | | | |
|---|---|---|---|---|---|
| D26,317 | S | | 11/1896 | Kloman | |
| 1,532,875 | A | * | 4/1925 | Brown | 273/294 |
| 2,466,805 | A | * | 4/1949 | Griffin | 434/98 |
| 3,869,125 | A | | 3/1975 | Odier | |
| D275,870 | S | * | 10/1984 | Koehn | D21/104 |
| 5,202,166 | A | * | 4/1993 | Crompton et al. | 428/33 |
| D339,613 | S | | 9/1993 | Pirnat | |
| 5,409,227 | A | * | 4/1995 | Walker | 273/157 R |
| 5,536,009 | A | * | 7/1996 | Edwards | 273/157 R |
| 5,601,470 | A | * | 2/1997 | Yao | 446/127 |
| D403,376 | S | | 12/1998 | Nissim | |
| 6,073,929 | A | * | 6/2000 | Nahon | 273/156 |

* cited by examiner

*Primary Examiner*—Kien T. Nguyen
(74) *Attorney, Agent, or Firm*—Fish & Richardson P.C.

(57) ABSTRACT

A puzzle includes a set of non-border pieces and a set of border pieces. Each border piece includes at least one segment not adjacent to another piece when the puzzle is assembled. Each non-border piece includes a first arc segment having a convex shape and a second arc segment having a convex shape. The second arc segment is superimposed on the first arc segment, has a radius of curvature smaller than a radius of curvature of the first arc segment to which it is superimposed, and is shaped to interfit with a concave arc segment of an adjacent piece. Non-border pieces are shaped to each include a second arc segment that is concentric with the first arc segment of an adjacent non-border piece. Non-border pieces are shaped to each include a first arc segment that is concentric with the first arc segment of an adjacent non-border piece.

25 Claims, 3 Drawing Sheets

PUZZLE

TECHNICAL FIELD

This invention relates to a puzzle.

BACKGROUND

Puzzles are popular forms of entertainment. In general, a puzzle is a set of irregularly shaped pieces that, when properly assembled, form a picture.

SUMMARY

In one general aspect, a puzzle includes a set of non-border pieces and a set of border pieces. Each border piece includes at least one segment not adjacent to another piece when the puzzle is assembled. Each non-border piece includes a first arc segment having a convex shape and a second arc segment being superimposed on the first arc segment. The second arc segment has a convex shape and is shaped to interfit with a concave arc segment of an adjacent piece.

Implementations may include one or more of the following features. For example, non-border pieces may be shaped such that their second arc segments are concentric with the first arc segments of adjacent non-border pieces. Non-border pieces may be shaped such that their first arc segments are concentric with the first arc segments of adjacent non-border pieces. The second arc segments may have radii of curvature that are smaller than radii of curvature of the first arc segments on which they are superimposed.

Non-border pieces may be shaped to each include a first arc segment and/or a second arc segmnet that spans an angle greater than 180°.

At least one piece in the puzzle may have a shape different from the shape of an adjacent piece.

Non-border pieces may be shaped such that their first arc segments interfit with concave arc segments of adjacent pieces. The first arc segments may connect with the second arc segments at a corner, that is, a point at which the slopes of the arc segments are discontinuous.

Non-border pieces may be shaped to each include a third arc segment. The third arc segment has a convex shape, is superimposed on the first arc segment, and is shaped to interfit with a concave arc segment of an adjacent piece. The third arc segment may be concentric with the first arc segment of an adjacent piece.

The puzzle provides for a different level of difficulty because of the arc segment cuts used to make the pieces.

Other features and advantages will be apparent from the description, the drawings, and the claims.

DESCRIPTION OF DRAWINGS

Like reference symbols in the various drawings indicate like elements.

DETAILED DESCRIPTION

Figure 1:
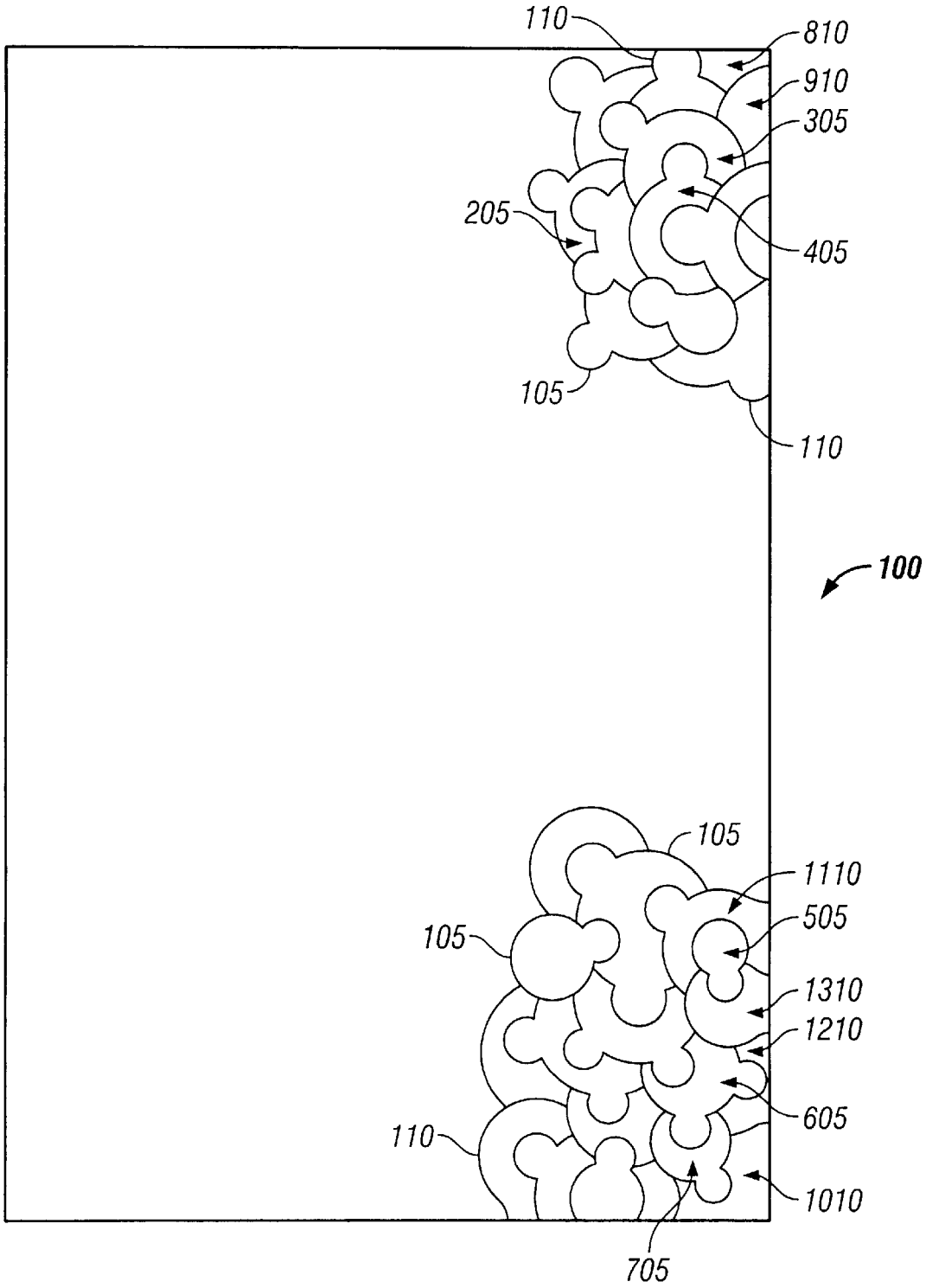
FIG. 1 shows a plan view of a puzzle with pieces in play.

Referring to FIG. 1, a puzzle 100 includes a set of non-border pieces 105 and a set of border pieces 110. Examples of non-border pieces 105 are shown in FIGS. 2–7 and examples of border pieces 110 are shown in FIGS. 8–13.

Each of the pieces 105 or 110 is formed to have a backboard (not shown). Although not shown in puzzle 100, in some puzzles, an image may be formed on, or adhered to, one side of the backboard.

In general, the puzzle 100 may be made with a die (not shown) that is positioned on one or more sides of the backboard such that the die is pressed into the side of the backboard. The die is made of thin strips of material (such as, metal) shaped into intricate patterns and fastened to a base. The edges of the die material on the exposed side of the die are sharpened to cut the backboard (and the image if an image is formed on the backboard) when the die is pressed into the backboard, so as to form the puzzle.

The backboard may be made of any well-known material that permits die cutting. For example, the backboard may be made of cardboard, sponge, or any soft board. If an image is formed onto the backboard, the image may be a visual rendering on a pliable material, such as, for example, paper or plastic, or may be rendered directly on the backboard. When formed on paper, plastic, or some other material, the image may be applied to the backboard using, for example, glue or any suitable adhesive.

The puzzle 100 may have any overall shape. The overall puzzle shape may be, for example, rectangular, circular, elliptical, polygonal, or irregular. In FIG. 1, the overall shape of the puzzle 100 is rectangular.

Generally, each non-border piece includes a first arc segment having a convex shape, which means that the boundary of the arc segment curves or bulges outward, like the exterior of a circle. The non-border piece includes a second arc segment also having a convex shape. The second arc segment is superimposed, or formed, on the first arc segment. The first arc segment connects with the second arc segment at a corner, which is a point at which the slope of the arc segment is discontinuous. The second arc segment is shaped to interfit with a concave arc segment of an adjacent piece, which may be a non-border piece 105 or a border piece 110. An arc segment has a concave shape if the boundary of the arc segment curves or bulges inward, like the interior of a circle. The second arc segment may have a radius of curvature smaller than a radius of curvature of the first arc segment on which it is superimposed. The radius of curvature of an arc segment is the distance from the center of the circle forming the arc segment to a point along an edge of the arc segment.

Additionally, a non-border piece may be shaped to include a third arc segment having a convex shape. The third arc segment may be superimposed, or formed, on the first arc segment to interfit with a concave arc segment of an adjacent piece. The first arc segment of a non-border piece may interfit with a concave arc segment of an adjacent piece. A non-border piece may be shaped such that one or more of the first arc segment, the second arc segment, and the concave arc segment spans an angle greater than 180°.

Figure 2:
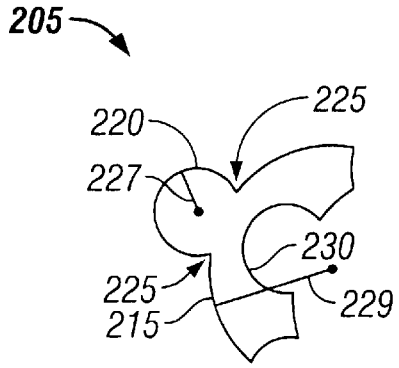
FIGS. 2–13 show plan views of pieces of the puzzle of FIG. 1.

Referring also to FIG. 2, a non-border piece 205 includes a first arc segment 215 and a second arc segment 220 superimposed on the first arc segment 215. The first arc segment 215 connects with the second arc segment 220 at a corner 225. The second arc segment 220 spans an angle greater than 180° and is shaped to interfit with a concave arc segment of an adjacent piece (not shown). Furthermore, a radius of curvature 227 of the second arc segment 220 is smaller than a radius of curvature 229 of the first arc segment 215.

Figure 3:
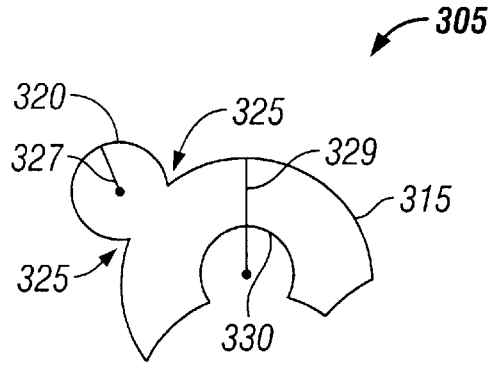

Referring also to FIG. 3, a non-border piece 305 includes a first arc segment 315 and a second arc segment 320 superimposed on the first arc segment 315. The first arc segment 315 spans an angle greater than 180° and connects with the second arc segment 320 at a corner 325. The second arc segment 320 spans an angle greater than 180° and is shaped to interfit with a concave arc segment 230 of the adjacent non-border piece 205 (shown in FIGS. 1 and 2). The concave arc segment 230 also spans an angle greater than 180°. Furthermore, a radius of curvature 327 of the second arc segment 320 is smaller than a radius of curvature 329 of the first arc segment 315.

Figure 4:
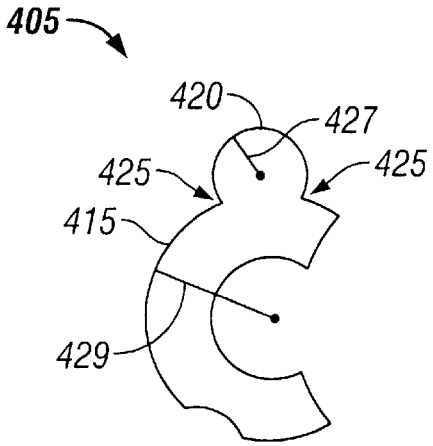

Referring also to FIG. 4, a non-border piece 405 includes a first arc segment 415 and a second arc segment 420 superimposed on the first arc segment 415. The first arc segment 415 spans an angle greater than 180° and connects with the second arc segment 420 at a corner 425. The second arc segment 420 spans an angle greater than 180° and is shaped to interfit with a concave arc segment 330 of the adjacent non-border piece 305 (shown in FIGS. 1 and 3). The concave arc segment 330 also spans an angle greater than 180°. As also shown, a radius of curvature 427 of the second arc segment 420 is smaller than a radius of curvature 429 of the first arc segment 415.

Figure 5:
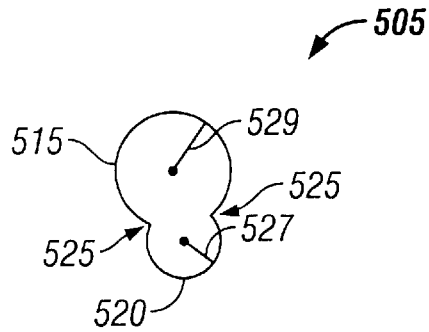

Referring also to FIG. 5, a non-border piece 505 includes a first arc segment 515 and a second arc segment 520 superimposed on the first arc segment 515. The first arc segment 515 spans an angle greater than 180° and connects with the second arc segment 520 at a corner 525. The second arc segment 520 spans an angle greater than 180° and is shaped to interfit with a concave arc segment 1330 of an adjacent border piece 1310 (shown in FIGS. 1 and 13). The first arc segment 515 of the non-border piece 505 interfits with a concave arc segment 1134 of an adjacent border piece 1110 (shown in FIGS. 1 and 11). The concave arc segment 1134 also spans an angle greater than 180°. Additionally, a radius of curvature 527 of the second arc segment 520 is smaller than a radius of curvature 529 of the first arc segment 515.

Figure 6:
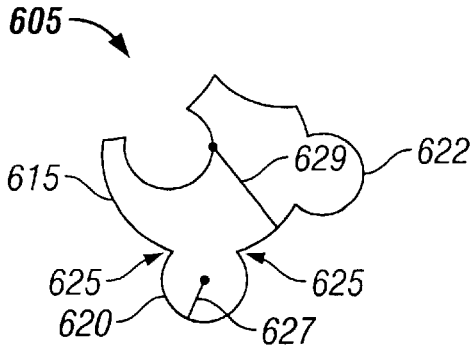

Referring also to FIG. 6, a non-border piece 605 includes a first arc segment 615 and a second arc segment 620 superimposed on the first arc segment 615. The first arc segment 615 spans an angle greater than 180° and connects with the second arc segment 620 at a corner 625. The second arc segment 620 spans an angle greater than 180° and is shaped to interfit with a concave arc segment 730 of an adjacent non-border piece 705 (shown in FIGS. 1 and 7). The concave arc segment 730 also spans an angle greater than 180°. Additionally, the non-border piece 605 includes a third arc segment 622 superimposed on the first arc segment 615 and shaped to interfit with a concave arc segment 1232 of an adjacent border piece 1210 (shown in FIGS. 1 and 12). The concave arc segment 1232 also spans an angle greater than 180°. As shown, a radius of curvature 627 of the second arc segment 620 is smaller than a radius of curvature 629 of the first arc segment 615.

Figure 7:
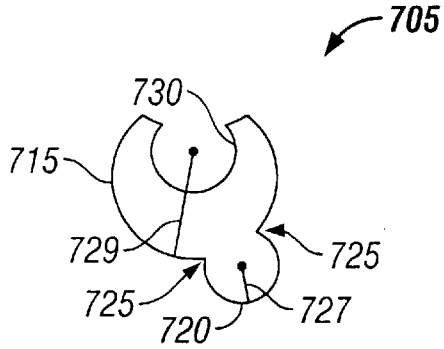
Figure 8:
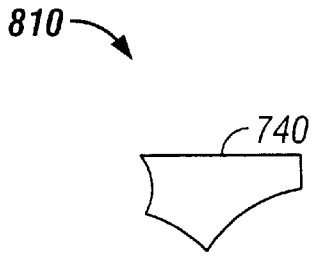
Figure 9:
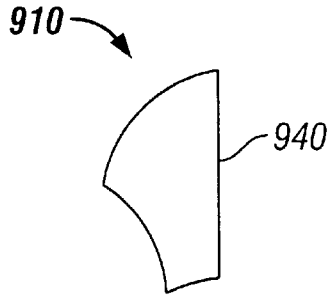

Referring also to FIG. 7, the non-border piece 705 includes a first arc segment 715 and a second arc segment 720 superimposed on the first arc segment 715. The first arc segment 715 spans an angle greater than 180° and connects with the second arc segment 720 at a corner 725. The second arc segment 720 spans an angle greater than 180° and is shaped to interfit with a concave arc segment 1030 of an adjacent border piece 1010 (shown in FIGS. 1 and 10). The concave arc segment 1030 also spans an angle greater than 180°. Furthermore, a radius of curvature 727 of the second arc segment 720 is smaller than a radius of curvature 729 of the first arc segment 715.

Generally, each border piece 110 in the border includes a border segment not adjacent to another piece (either a non-border piece or another border piece 110). The border segment may be of any suitable shape to form the overall shape of the puzzle. For example, the border segment may be a straight edge if the overall shape of the puzzle is polygonal or rectangular. As another example, the border segment may be curved if the overall shape of the puzzle is elliptical or circular. If the overall shape of the puzzle is irregular, then the border segment may have an irregular shape.

Referring to FIGS. 8–13, a border piece 810 includes a border segment 840, a border piece 910 includes a border segment 940, a border piece 1010 includes a border segment 1040, a border piece 1110 includes a border segment 1140, a border piece 1210 includes a border segment 1240, and a border piece 1310 includes a border segment 1340.

Figure 10:
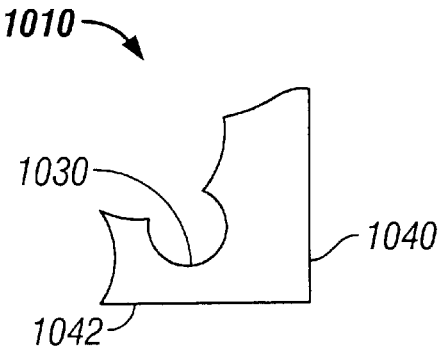
Figure 11:
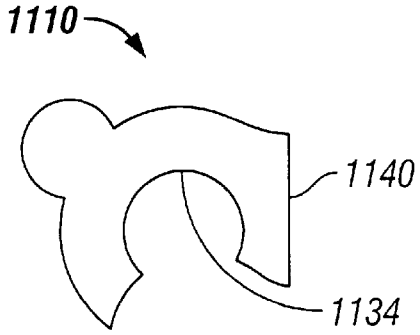
Figure 12:
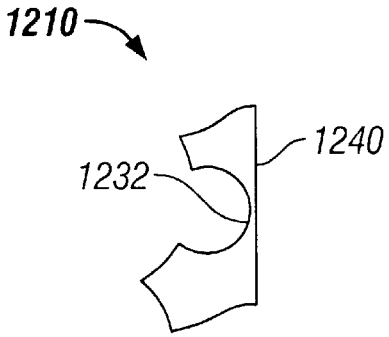
Figure 13:
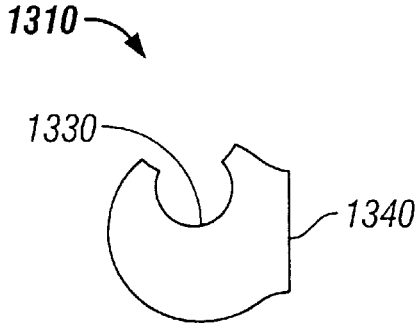

A border piece may include more than one border segment. As shown in FIG. 10, the border piece 1010 includes another border segment 1042.

Other implementations are within the scope of the following claims.

What is claimed is:

1. A puzzle comprising:

a set of non-border pieces; and a set of border pieces, each border piece including at least one segment not adjacent to another piece when the puzzle is assembled;

wherein:

each non-border piece includes:

a first arc segment having a convex shape, and a second arc segment having a convex shape, being superimposed on the first arc segment, having a radius of curvature smaller than a radius of curvature of the first arc segment to which it is superimposed, and being shaped to interfit with a concave arc segment of an adjacent piece;

non-border pieces are shaped to each include a second arc segment that is concentric with the first arc segment of an adjacent non-border piece;

non-border pieces are shaped to each include a first arc segment that is concentric with the first arc segment of an adjacent non-border piece.

2. A puzzle comprising:

a set of non-border pieces; and a set of border pieces, each border piece including at least one segment not adjacent to another piece when the puzzle is assembled;

wherein:

each non-border piece includes:

a first arc segment having a convex shape, and a second arc segment being superimposed on the first arc segment, having a convex shape, and being shaped to interfit with a concave arc segment of an adjacent piece; and non-border pieces are shaped to each include a second arc segment that is concentric with the first arc segment of an adjacent non-border piece.

3. The puzzle of claim 2 in which non-border pieces are shaped to each include a first arc segment that spans an angle greater than 180°.

4. The puzzle of claim 2 in which non-border pieces are shaped to each include a second arc segment that spans an angle greater than 180°.

5. The puzzle of claim 2 in which at least one piece has a shape different from the shape of an adjacent piece.

6. The puzzle of claim 2 in which non-border pieces are shaped to each include a first arc segment that interfits with a concave arc segment of an adjacent piece.

7. The puzzle of claim 2 in which the first arc segment connects with the second arc segment at a corner.

8. The puzzle of claim 2 in which non-border pieces are shaped to each include a third arc segment, with a third arc segment having a convex shape, being superimposed on the first arc segment, and being shaped to interfit with a concave arc segment of an adjacent piece.

9. The puzzle of claim 8 in which the third arc segment is concentric with the first arc segment of an adjacent piece.

10. A puzzle comprising:

a set of non-border pieces; and a set of border pieces, each border piece including at least one segment not adjacent to another piece when the puzzle is assembled;

wherein:

each non-border piece includes:

a first arc segment having a convex shape, and a second arc segment being superimposed on the first arc segment, having a convex shape, and being shaped to interfit with a concave arc segment of an adjacent piece; and non-border pieces are shaped to each include a first arc segment that is concentric with the first arc segment of an adjacent non-border piece.

11. The puzzle of claim 10 in which non-border pieces are shaped to each include a first arc segment that spans an angle greater than 180°.

12. The puzzle of claim 10 in which non-border pieces are shaped to each include a second arc segment that spans an angle greater than 180°.

13. The puzzle of claim 10 in which at least one piece has a shape different from the shape of an adjacent piece.

14. The puzzle of claim 10 in which non-border pieces are shaped to each include a first arc segment that interfits with a concave arc segment of an adjacent piece.

15. The puzzle of claim 10 in which the first arc segment connects with the second arc segment at a corner.

16. The puzzle of claim 10 in which non-border pieces are shaped to each include a third arc segment, with a third arc segment having a convex shape, being superimposed on the first arc segment, and being shaped to interfit with a concave arc segment of an adjacent piece.

17. The puzzle of claim 16 in which the third arc segment is concentric with the first arc segment of an adjacent piece.

18. A puzzle comprising:

a set of non-border pieces; and a set of border pieces, each border piece including at least one segment not adjacent to another piece when the puzzle is assembled;

wherein:

each non-border piece includes:

a first arc segment having a convex shape, and a second arc segment being superimposed on the first arc segment, having a convex shape, having a radius of curvature smaller than a radius of curvature of the first arc segment to which it is superimposed, and being shaped to interfit with a concave arc segment of an adjacent piece.

19. The puzzle of claim 18 in which non-border pieces are shaped to each include a first arc segment that spans an angle greater than 180°.

20. The puzzle of claim 18 in which non-border pieces are shaped to each include a second arc segment that spans an angle greater than 180°.

21. The puzzle of claim 18 in which at least one piece has a shape different from the shape of an adjacent piece.

22. The puzzle of claim 18 in which non-border pieces are shaped to each include a first arc segment that interfits with a concave arc segment of an adjacent piece.

23. The puzzle of claim 18 in which the first arc segment connects with the second arc segment at a corner.

24. The puzzle of claim 18 in which non-border pieces are shaped to each include a third arc segment, with a third arc segment having a convex shape, being superimposed on the first arc segment, and being shaped to interfit with a concave arc segment of an adjacent piece.

25. The puzzle of claim 24 in which the third arc segment is concentric with the first arc segment of an adjacent piece.

* * * * *